US008292661B2

(12) United States Patent
Montena

(10) Patent No.: US 8,292,661 B2
(45) **Date of Patent: *Oct. 23, 2012**

(54) PHONE PLUG CONNECTOR DEVICE

(75) Inventor: Noah Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/209,587

(22) Filed: Aug. 15, 2011

(65) Prior Publication Data

US 2011/0300747 A1 Dec. 8, 2011

Related U.S. Application Data

(63) Continuation of application No. 12/540,683, filed on Aug. 13, 2009, now Pat. No. 7,997,929.

(51) Int. Cl.
*H01R 9/05* (2006.01)

(52) U.S. Cl. ..... 439/578; 439/668

(58) Field of Classification Search ..... 439/578, 439/579, 580, 668, 669, 582
See application file for complete search history.

(56) References Cited

U.S. PATENT DOCUMENTS

| | | | |
|---|---|---|---|
| 2,238,834 | A | 4/1941 | Travers |
| 2,449,983 | A | 9/1948 | Devol |
| 2,761,110 | A | 8/1956 | Edlen et al. |
| 3,184,706 | A | 5/1965 | Atkins |
| 3,683,320 | A | 8/1972 | Woods et al. |
| 3,706,958 | A | 12/1972 | Blanchenot |
| 4,261,632 | A | 4/1981 | Narozny |
| 4,352,240 | A | 10/1982 | Komada |
| 4,374,458 | A | 2/1983 | Komada |
| 4,553,806 | A | 11/1985 | Forney, Jr. et al. |
| 4,557,546 | A | 12/1985 | Dreyer |
| 4,688,877 | A | 8/1987 | Dreyer |
| 4,789,355 | A | 12/1988 | Lee |
| 4,799,902 | A | 1/1989 | Laudig et al. |
| 5,066,248 | A | 11/1991 | Gaver, Jr. et al. |
| 5,073,129 | A | 12/1991 | Szegda |
| 5,261,839 | A | 11/1993 | Franks, Jr. |
| 5,318,458 | A | 6/1994 | Thorner |
| 5,362,251 | A | 11/1994 | Bielak |
| 5,470,257 | A | 11/1995 | Szegda |

(Continued)

FOREIGN PATENT DOCUMENTS

DE 4229812 C1 3/1994

OTHER PUBLICATIONS

U.S. Appl. No. 13/157,763, filed Jun. 10, 2011.

(Continued)

*Primary Examiner* — R S Luebke
*Assistant Examiner* — Harshad Patel
(74) *Attorney, Agent, or Firm* — Schmeiser, Olsen & Watts LLP

(57) ABSTRACT

A phone plug connector device having a preassembled phone plug and connector, wherein the phone plug includes a conductive tip and a stem, wherein the connector connects the phone plug to a coaxial cable, wherein the coaxial cable comprises a center conductor surrounded by a first dielectric, the first dielectric being surrounded by a first conductive sheath, and the first conductive sheath surrounded by a protective outer jacket, wherein the connector connects the coaxial cable to the phone plug mechanically and electrically by compression.

14 Claims, 15 Drawing Sheets

U.S. PATENT DOCUMENTS 5,527,190 A 6/1996 Weingartner
5,890,925 A 4/1999 Bernardini
5,997,350 A 12/1999 Burris et al.
6,109,963 A 8/2000 Follingstad et al.
6,116,945 A 9/2000 Davis et al.
6,123,567 A 9/2000 McCarthy
6,149,469 A 11/2000 Kim
6,153,830 A 11/2000 Montena
6,179,656 B1 1/2001 Wong
6,210,222 B1 * 4/2001 Langham et al. ..... 439/583
6,254,430 B1 7/2001 Endo et al.
6,261,126 B1 7/2001 Stirling
6,331,123 B1 12/2001 Rodrigues
6,517,379 B2 2/2003 Leve
6,558,194 B2 5/2003 Montena
6,568,964 B2 5/2003 D'Addario
6,575,784 B1 6/2003 Yamada
6,644,993 B2 11/2003 Victor
6,676,446 B2 1/2004 Montena
6,705,884 B1 3/2004 McCarthy
6,722,902 B2 4/2004 Kedzierski
6,729,912 B2 5/2004 D'Addario
6,749,454 B2 6/2004 Schmidt et al.
6,764,350 B2 7/2004 Kosmala
6,786,774 B2 9/2004 Haas, II et al.
6,848,940 B2 2/2005 Montena
6,860,760 B2 3/2005 Endo et al.
6,884,113 B1 4/2005 Montena
6,966,796 B2 11/2005 Abe et al.
7,029,326 B2 4/2006 Montena
7,048,579 B2 5/2006 Montena
7,121,872 B1 10/2006 Hanks
7,153,159 B2 12/2006 Burris et al.
7,156,695 B2 1/2007 Holliday
D542,225 S 5/2007 Victor
7,217,155 B2 5/2007 Montena
7,226,320 B2 6/2007 Abe et al.
7,311,554 B1 12/2007 Jackson et al.
7,458,849 B2 12/2008 Rodrigues et al.
7,458,851 B2 12/2008 Montena
7,476,119 B2 1/2009 D'Addario et al.
7,488,187 B2 2/2009 Wolf
7,857,643 B2 12/2010 Dobler
8,016,615 B2 9/2011 Montena
2003/0207620 A1 11/2003 Haas, II et al.
2003/0224658 A1 12/2003 Koch et al.
2005/0085125 A1 4/2005 Montena
2005/0164553 A1 7/2005 Montena
2006/0014425 A1 1/2006 Montena
2006/0063426 A1 3/2006 Khemakhem et al.
2006/0194474 A1 8/2006 Montena
2008/0045082 A1 2/2008 Kuo
2008/0261445 A1 10/2008 Malloy et al.
2009/0186503 A1 7/2009 Dobler
2009/0233482 A1 9/2009 Chawgo et al.
2010/0144183 A1 6/2010 Nania et al.
2010/0203760 A1 8/2010 Montena
2011/0039449 A1 2/2011 Montena
2011/0059648 A1 3/2011 Montena
2011/0059649 A1 3/2011 Montena
2011/0306226 A1 12/2011 Montena
2011/0306247 A1 12/2011 Montena
2012/0003870 A1 1/2012 Montena
2012/0094521 A1 4/2012 Montena

OTHER PUBLICATIONS

U.S. Appl. No. 13/231,011, filed Sep. 13, 2011.
Notice of Allowance-2 (Mail Date Apr. 11, 2011) for U.S. Appl. No. 12/540,683, filed Aug. 13, 2009.
Office Action (Mail Date May 24, 2012 for U.S. Appl. No. 13/157,763, filed Jun. 10, 2011.
U.S. Appl. No. 12/955,978, filed Nov. 30, 2010.
U.S. Appl. No. 13/152,431, filed Jun. 3, 2011.

* cited by examiner

PHONE PLUG CONNECTOR DEVICE

This application is a continuation application, claiming priority to and the benefit of U.S. application Ser. No. 12/540,683, filed Aug. 13, 2009, now U.S. Pat. No. 7,997,929, entitled "PHONE PLUG CONNECTOR DEVICE."

TECHNICAL FIELD

Embodiments of the present invention relate generally to coaxial cable connectors, and more particularly to, compression connectors for use with phone plugs

BACKGROUND

Currently, two-conductor tip-sleeve (TS) connectors, also known as phone plugs, are widely available as part of pre-made jumper assemblies and also as field installable connector/cable kits. Pre-made assemblies are of good to excellent build quality, but are not always convenient in length. Either they are too long and create unnecessary loss in a studio set-up, or they are too short and not repairable in a live performance or road set-up. Due to the long length of the head shell of the connector, the cable will be forced to have a tight bend radius, which can be inconvenient to use. Moreover, the diameter of the head shell tends to be too bulky creating clearance problems at the point of insertion of the plug into the panel. It may not be possible to fit plugs into consecutive or adjacent slots due to the large size of each connector. Field installable connectors solve the needs of custom preparations and make it easier to repair a damaged end, but they require clumsy set-screw connections, which often become loose over time and require bulky connector bodies to house the components, or solder, which requires soldering gear, both which can be a nuisance to use.

Another problem with current connectors, factory installed or otherwise, is that the internal wire terminations are two non-coaxial individual terminals requiring non-coaxial break-out of the cable end, losing any shielding benefits of the cable and plug conductors being coaxial.

Additionally, the standard phone plug configurations do not always provide secure ground/shield contact, often relying upon the connector being pulled to one side within the jack. There are connectors available with a spring metal ring inset in the sleeve to improve contact, but as a separate part, it can create an additional point of contact that may become corroded or become separated due to misuse.

Currently, there are available preassembled coaxial cable connectors for use with F connectors, such as axially-compressible F connectors that are used to attach a coaxial cable to another object, such as an appliance or junction, having a terminal adapted to engage the coaxial cable connector. After an end of the coaxial cable is trimmed using one of several known cable preparation techniques, the trimmed end of the coaxial cable is inserted into a back end of the connector. Then, the coaxial cable connector is axially compressed using one of several known installation tools, and the coaxial cable connector and the coaxial cable become permanently attached to each other. Although such preassembled compressible connectors are known for use with F connectors, there are no suitable compressible preassembled phone plug connectors available on the market.

U.S. Pat. No. 6,786,774 is directed to a two-conductor cable and phone plug assembly that requires assembly of components during installation. The metal band that is used to crimp the shield of the coaxial cable is a loose piece that could be easily dropped or lost.

There remains a need to provide solderless collectors for phone plugs. It would be beneficial to provide phone plug connectors for coaxial cables that continue the coaxial relationship of the two conductors inside the connector. It would be advantageous to provide phone plug connectors with reduced length to reduce strain and stress in the cable during use. It would be beneficial to improve the usability of phone plugs in narrowly spaced equipment cabinets.

SUMMARY OF THE INVENTION

It is a primary object of an embodiment of the invention to provide a phone plug connector device having a preassembled phone plug and connector, wherein the phone plug includes a pin having a conductive tip and a stem, wherein the phone plug and connector comprise a series of conductors concentrically arranged in the phone plug connector device, wherein the connector connects the phone plug to a coaxial cable. The coaxial cable includes a center conductor surrounded by at least a first dielectric, the first dielectric being surrounded by at least a first conductive sheath, and the first conductive sheath surrounded by a protective outer jacket. The connector is adapted to mechanically and electrically connect by axial compression the center conductor of the coaxial cable to one conductor in the series of conductors of the phone plug and connector and the first conductive sheath of the coaxial cable to another conductor in the series of conductors of the phone plug and connector. The first conductive sheath may include one or more foil layers and one or more braided conductive sheaths. Each conductive sheath will be separated from the other conductors by a dielectric layer.

According to another aspect of the phone plug connector device, the connector connects the coaxial cable to the phone plug mechanically and electrically solely by compression. The connector and the phone plug may be axially aligned or may be positioned at an angular relationship with respect to one another. The angle of position may be any angle including but not limited to angles between forty-five and one hundred eighty degrees.

According to a further aspect of the phone plug connector device, the device is provided in a preassembled single unit configuration prior to installation of the cable. The components or parts of the phone plug and connector may be configured for an interference fit with each other or may be joined in other ways at the factory, such as by soldering or welding certain pieces together. The strength of the connection between the connector device' and the cable in the present invention may be greater than the breaking strength of the cable when the cable is fastened therein.

According to a further aspect of the phone plug connector device the phone plug may include a tip sleeve (TS) plug. Phone plugs are available in various sizes including quarter-inch (6.3 mm) size and in miniaturized versions (3.5 and 2.5 mm). The TS plug is a two-contact plug, most commonly used for audio connections.

According to yet another aspect of the phone plug connector device, the series of conductors comprise a portion in the stem of the phone plug, configured for engaging and electrically contacting the center conductor of the coaxial cable, and a post located in the connector for electrically contacting the at least first conductive sheath. The connector further includes a connector body and a fastener, wherein the pot is configured for an interference fit with the phone plug, wherein the fastener is operative engagement with the connector body, wherein the connector body is configured for an interference fit with the post, and wherein, upon axial advancement of the fastener, the connector securely fastens to the cable by compression.

According to still a further aspect of the phone plug connector device, the post is tubular for receiving the coaxial cable, the tubular post having a first end and a second end, a first flange disposed on the outer surface of the first end and a second flange of greater diameter disposed on the outer surface of the second end.

According to another aspect of the phone plug connector device, the connector body is disposed radially about the tubular post, wherein the connector body is radially spaced about the post to define a first outer cavity between the post and the connector body, the connector body having a first end and a second end, wherein the second end of the connector body abuts the second flange of the post.

According to yet another aspect of the phone plug device, the fastener is disposed radially about a portion of the connector body, the fastener having an internal wall thickness of varying thickness over three sections, wherein the first section has a constant thickness T1, the second section has a tapered thickness T2, and the third section has a constant thickness T3, wherein T1 is greater than T3 and wherein T2 decreases in thickness from T1 to T3, and wherein the fastener engages the connector body at the tapered thickness of the second section when the fastener is in a first position.

According to a further aspect of the phone plug connector device, the connector body further includes a detent on its outer surface and a plurality of annular serrations disposed on its inner surface, and the fastener includes a groove on its inner surface for engaging the detent on the connector body.

According to still a further aspect of the phone plug connector device, the fastener engages the connector body by interference fit at the first section having thickness T1, wherein axial movement of the fastener from a first position to a second position radially compresses the connector body for a compressed fit with the cable.

According to yet another aspect of the phone plug connector device, the phone plug includes a tip and a stem, a first insulator disposed on the stem, and a shield is disposed on the first insulator. The shield may further include a plurality of slots therein to provide resilient ring contact with a jack into which the phone plug is inserted. The stem is configured to engage and electrically connect to the center conductor of the cable. One example of configuration includes the stem having a bore and a spring contact positioned in the bore for providing contact between the center conductor and the pin.

It is a further embodiment of the present invention to provide a phone connector device having a post and shield combined into a single unit. The phone plug connector device provides a continuous protective shield from electrical interference the length of the connector when the connector device is in an installed configuration.

It is another embodiment of the present invention to provide a phone connector device having a tubular post for receiving the coaxial cable, the tubular post having a first end and a second end, a first flange disposed on the outer surface of the first end and a second flange of greater diameter disposed on the outer surface of the second end; a connector body configured for interference fit with the post, the connector body disposed radially about the tubular post, wherein the connector body is radially spaced about the post to define a first outer cavity between the post and the connector body, the connector body having a first end and a second end, wherein the second end of the connector body abuts the second flange of the post; and a fastener disposed radially inside an edge of the connector body, the fastener having an internal wall thickness of varying thickness over three sections, wherein the first section has a tapered thickness T1, the second section has a constant thickness T2, and the third section has a tapered thickness T3, wherein thickness T3 is less than thickness T1 and the angle of taper of thickness T3 is greater than the angle of taper of thickness T1 with respect to the exterior or top side of the fastener; wherein the connector body further comprises a groove on its inner surface and the fastener further comprises a detent for engaging the groove on the connector body when the fastener is in a first preassembled position; and wherein the connector body engages the fastener by interference fit when a cable is disposed in the connector and the fastener is in a second position, wherein axial movement of the fastener radially compresses the cable for a compressed fit with the cable.

It is yet a further embodiment of the present invention to provide a phone plug connector device having a tubular post for receiving the coaxial cable, the tubular post having a first end and a second end, a first flange disposed on the outer surface of the first end and a second flange of greater diameter disposed on the outer surface of the second end; a connector body configured for interference fit with the post, the connector body having a first end and a second end, a first portion of the first end of the connector body radially spaced about a first portion of the tubular post to define a first outer cavity between the post and the connector body, a second portion of the first end of the connector body configured to fit by interference with a second portion of the tubular post, the second end of the connector body radially disposed on the stem of the phone plug, an insulator sandwiched between the second end of the connector body and the stem of the phone plug, the second end of the connecter body configured for interference fit with the insulator and the stem; a fastener disposed radially inside an edge of the connector body, the fastener having an internal wall thickness of varying thickness over three sections, wherein the first section has a tapered thickness T1, the second section has a constant thickness T2, and the third section has a tapered thickness T3, wherein thickness T3 is less than thickness T1 and the angle of taper of thickness T3 is greater than the angle of taper of thickness T1 with respect to the exterior or top side of the fastener; wherein the connector body further comprises a groove on its inner surface and the fastener further comprises a detent for engaging the groove on the connector body when the fastener is in a first preassembled position; and wherein the connector body engages the fastener by interference fit when a cable is disposed in the connector and the fastener is in a second position, wherein axial movement of the fastener radially compresses the cable for a compressed fit with the cable.

It is another embodiment of the present invention to provide a phone plug connector device having a post and a fastener, wherein the post and fastener are configured for an interference fit with the phone plug; wherein the post is tubular for receiving the coaxial cable, the tubular post having a first end and a second end, a series of serrations disposed on the outer surface of the first end and a second flange of greater diameter disposed on the outer surface of the second end; the fastener configured for interference fit with the post, the fastener positioned radially about the tubular post, wherein the fastener is radially spaced about the post to define a first outer cavity between the post and the fastener, the fastener having a first end and a second end, wherein the second end of the fastener abuts the second flange of the post, the fastener comprises a series of ridges disposed on the first end; and wherein the fastener radially engages a cable disposed in the post by crimping the series of ridges disposed on the fastener.

It is another embodiment of the present invention to provide a phone plug connector device having an intermediate joining component for retaining the phone plug and connector therein, the intermediate joining component comprising at least a first and a second opening for insertion of the phone plug and connector therein.

According to a further aspect of the phone plug connector device, the phone plug comprises a tip and a stem, an insulator radially disposed on the stem, and a shield radially disposed on the insulator; the stem, insulator and shield configured for interference fit with one another; the shield is configured for interference fit with the opening in the intermediate joining component; wherein the connector comprises a post, connector body and a fastener, the post and connector body configured for interference fit with each other and with the intermediate joining component, the connector body comprises a detent on its outer surface and the fastener comprises a groove on its inner surface for engaging the detent on the connector body. The stem is configured for engaging and electrically contacting the center conductor of the coaxial cable with the pin. The stem may comprise a bore for receiving the center conductor, wherein the bore is axially aligned with the axis of the post.

It is a further embodiment of the present invention to provide a method of mounting a phone plug connector device to a prepared terminal end of a coaxial cable having a center conductor surrounded by at least a first dielectric, the at least first dielectric being surrounded by at least a first conductive sheath, and the at least first conductive sheath surrounded by a protective outer jacket, the method including (a) providing a phone plug and connector device, wherein the phone plug comprises a conductive tip and a stem, wherein the stem is configured for engaging and making electrical contact with the center conductor, a first insulator disposed on the stem, and a shield disposed on the first insulator; wherein the connector comprises a post, connector body, and a fastener, the connector body and the fastener are configured for an interference fit with each other; wherein the post comprises a first inner cavity; wherein the outer surface of the post and the inner surface of the connector body comprise a first outer cavity; (b) separating the center conductor and first dielectric from the at least first conductive sheath and outer jacket of the coaxial cable; (c) inserting the separated end of the coaxial cable into the fastener when the fastener is in a first position and advancing the cable to insert the center conductor into the stem for contact with the stem and the at least first dielectric into the first inner cavity of the post, and wherein the at least first conductive sheath and protective outer jacket are positioned in the first outer cavity between the post and the connector body; (d) moving die fastener axially from the first position to a second position to seal and grip the at least first conductive sheath and protective outer jacket.

It is a still another embodiment of the present invention to provide a method of mounting a phone plug connector device to a prepared terminal end of a coaxial cable having a center conductor surrounded by at least a first dielectric, the at least first dielectric being surrounded by at least a first conductive sheath, and the at least first conductive sheath surrounded by a protective outer jacket, the method including (a) providing a phone plug and connector device, wherein the phone plug comprises a conductive tip and a stem, wherein the stem is configured for engaging and making electrical contact with the center conductor, a first insulator disposed on the stem, and a shield disposed on the first insulator; wherein the connector comprises a post and a fastener and wherein the post and the fastener are configured for an interference fit with each other; wherein the post comprises a first inner cavity; wherein the outer surface of the post and the inner surface of the fastener body comprise a first outer cavity; wherein the fastener comprises a series of ridges on the outer surface thereof; (b) separating the center conductor and first dielectric from the at least first conductive sheath and outer jacket of the coaxial cable; (c) inserting the separated end of the coaxial cable into the fastener when the fastener is in a first position and advancing the cable to insert the center conductor into the stem for contact with the stem and the at least first dielectric into the first inner cavity of the post, and wherein the at least first conductive sheath and protective outer jacket are positioned in the first outer cavity between the post and the fastener; (d) radially crimping the series of ridges disposed on the fastener to seal and grip the at least first conductive sheath and protective outer jacket.

The phone plug connector device provides electrically protective shielding throughout the entire connector to prevent noise and interference of external or environmental conductors from affecting the signal on the center wire. Moreover, the shield prevents the signal from the center wire from radiating outside the connector. Additionally, the compactness of the connector allows closer spacing between phone plug connectors and offers more clearance between conventionally spaced sockets.

BRIEF DESCRIPTION OF THE DRAWINGS

Embodiments of the present invention will be more fully understood and appreciated by reading the following Detailed Description in conjunction with the accompanying drawings, in which.

DETAILED DESCRIPTION

"Present invention" means at least some embodiments of the present invention; references to various feature(s) of the "present invention" throughout this document do not mean that all claimed embodiments or methods include the referenced feature(s).

Figure 1:
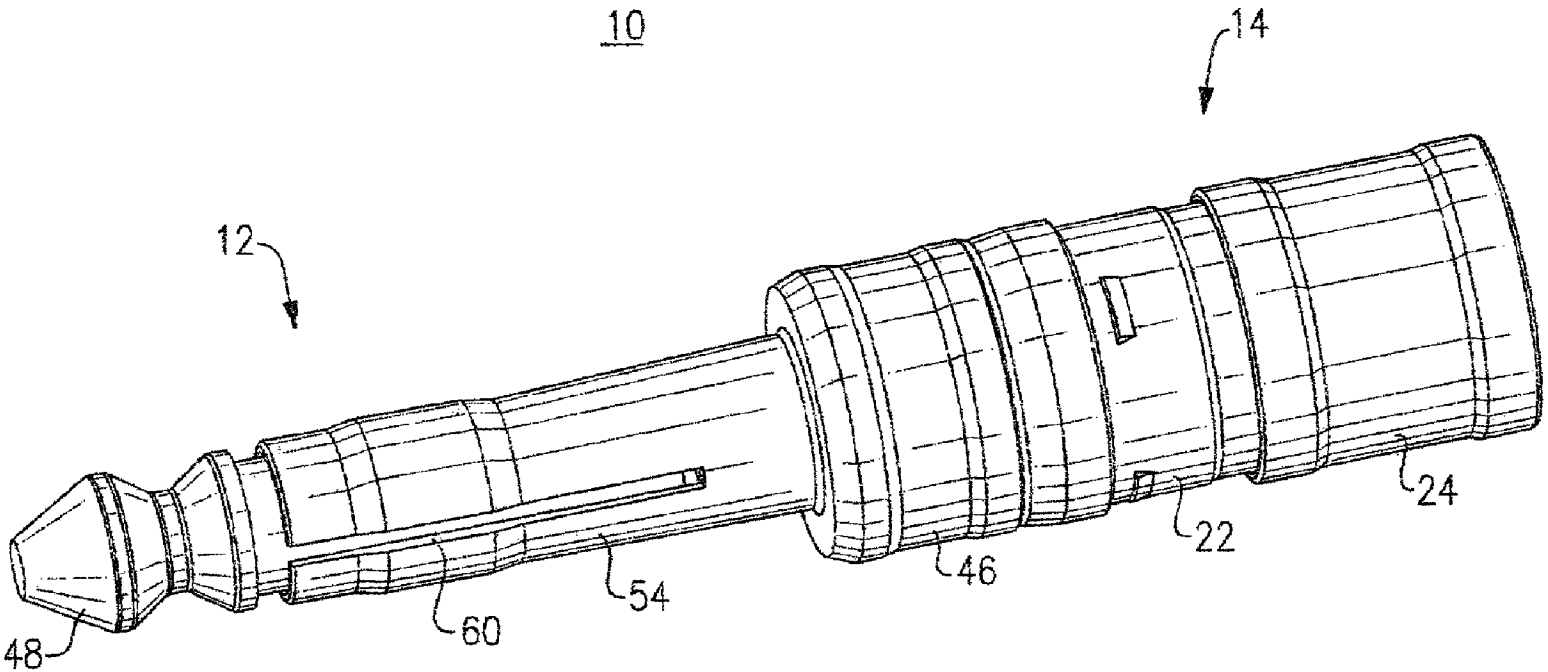
FIG. 1 is a perspective view of an embodiment of a phone plug connector device of the present invention.

As will be appreciated, an embodiment of the present invention provides a phone plug connector device 10 as shown in FIG. 1. Phone plug connector device 10 includes a phone plug 12 and a connector 14. Device 10 is preferably provided as a preassembled configuration to ease handling and installation during use.

Connector 14 connects phone plug 12 to a coaxial cable by means of compression without the need for soldering, crimping or tooling of individual conductors. The coaxial cable can be a known type having an electrical center conductor surrounded by and spaced radially inwardly from a braid conductor or conductive sheath by a foil and an insulator core. A dielectric covering or sheathing jacket surrounds the braid and includes the outermost layer of the cable. The cable may include several layers of conductive sheath with or without foil layers. Any form of coaxial cable may be used herein and it is not limited to that just described.

The type of compression used in connector 14 (and connector 104 further described below) may be any form including but not limited to configurations set forth in U.S. Pat. Nos. 6,558,194, 6,153,830, 5,470,257, and 6,261,126, all of which are hereby incorporated by reference. It is important that the compression configuration used herein is easily assembled and may be preassembled and already connected to phone plug 12 as a single or unitary configuration prior to installation. Connector 14 includes a number of components that fit, press or snap together without the need for soldering. The shape and configuration of the components or pieces that make up connector 14 may vary depending upon the way the pieces fit together.

It is preferable that the components of the embodiments of the device of the present invention fit together by interference fit or compression, which can be achieved by friction after the parts are pushed together rather than by other means of fastening. "Interference" refers to the act that one part slightly interferes with the spatial location of another, and commonly includes arrangements referred to as a press fit.

Figure 2:
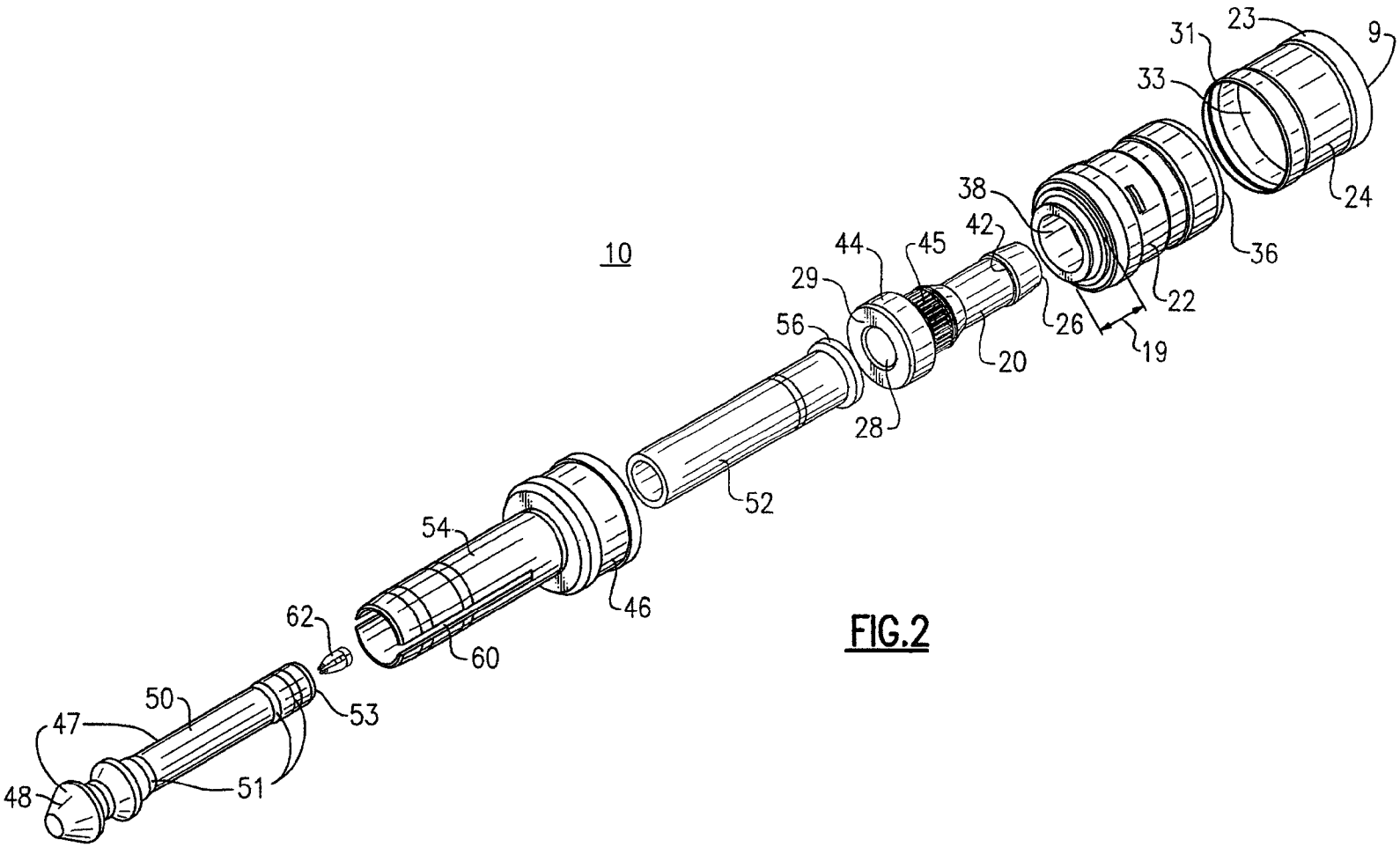
FIG. 2 is an exploded perspective view of the phone plug connector device of FIG. 1.

FIGS. 1 through 4 illustrate but one configuration used herein to create connector 14. Reference is made to FIG. 2, which shows an exploded view of phone plug connector device 10 and FIGS. 3 and 4, which show section views of phone plug connector device 10. Connector 14 is configured to accommodate receiving the prepared end of a coaxial cable. Connector 14 includes a post or tubular body 20 for receiving a coaxial cable. Prior to insertion into post 20, the coaxial cable is prepared by selectively removing various layers to expose an end of the center conductor, insulator core and foil. An end portion of the braid conductor is folded over the sheathing jacket.

Connector 14 further includes a connector body 22 and a compression ring or fastener 24. Post 20 has a first opening 26 at first end 27 and a second opening 28 at second-end 29 that defines a first inner cavity 30. Connector body 22 is radially spaced about post 20 to define a first outer cavity 32 accessible via an opening 34 at a first end 36 in connector body 22. First outer cavity 32 is open at the first end 36 and closed at the opposite or second end 38 of connector body 22.

Preferably, connector body 22 and post 20 are separate components in connector 14, wherein connector body 22 is press fitted onto the outer surface of post 20: Post 20 is fabricated of a conductive material such as brass and connector body 22 may be fabricated of a plastic or metal or other suitable material. Preferably, connector body 22 is formed of brass or a copper alloy. In an alternative embodiment, connector body 22 and post 20 can be formed integrally as a single piece.

The inner surface or inner wall of the connector body 22 may include annular serrations 40 disposed opposite the post 20. Similar serrations are illustrated and described in U.S. Pat. No. 5,073,129, which is incorporated herein in its entirety. Post 20 and annular serrations 40 of connector body 22 provide for a continuous environmental seal and grip on the braid and sheathing jacket of the cable when all components of connector 14 are in place. A raised lip or flange 42 at first end 26 on the outer surface of post 20 further aids in the retention of braid and sheathing jacket of the cable. The outer surface of second end 29 on post 20 includes a second raised lip or flange 44 of larger outer diameter than the outer diameter of flange 42. Flange 44 abuts second end 38 of connector body 22 preventing connector body 22 from forward movement. Post 20 can also include a ribbed section 45 of smaller outer diameter than the diameter of flange 44 on its outer annular surface proximate flange 44 for engaging connector body 22, which is otherwise attached to post 20 by an interference fit, to insure a secured attachment with connector body 22. Ribbed section 45 prevents rotation of connector body 22 on post 20.

As shown in FIGS. 1-4, phone plug 12 includes a pin 47 having a tip 48 and a stem 50. Stem 50 may include ribs 51 that extend radially on stem 50. Tip 48 and stem 50 are fabricated of a conductive material such as brass, copper, or stainless steel, and preferably plated for wear resistance and corrosion resistance. An insulator 52 is disposed radially on stem 50. Insulator 52 includes a raised lip or flange 56 at a first end. Ribs 51 on stem 50 assist in maintaining insulator 52 on stem 50. A shield 54 is disposed radially on insulator 52. The shield 54 is fabricated of a conductive material such as brass, copper, or stainless steel and preferably plated for wear resistance and corrosion resistance. The shield 54 may include a cap end or shoulder 46, which fits radially about raised lip 44 of post 20 and flange 56 of insulator 52, which also abuts and engages the interior of rim 58 of shoulder 46, sandwiched between rim 58 and the second end 29 of post 20, thereby coupling phone plug 12 to connector 14. The opposite end of shoulder 46 fits by interference with a stepped section 19 of connector body 22 of lesser diameter than the remainder of the diameter of connector body 22. Shield 54 may contain slots 60 extending longitudinally thereon to further assist in maintaining phone plug 12 in a jack when in use. Slots 60 are optional and can provide resilient ring contact with a jack into which phone plug 12 is inserted.

Figure 3:
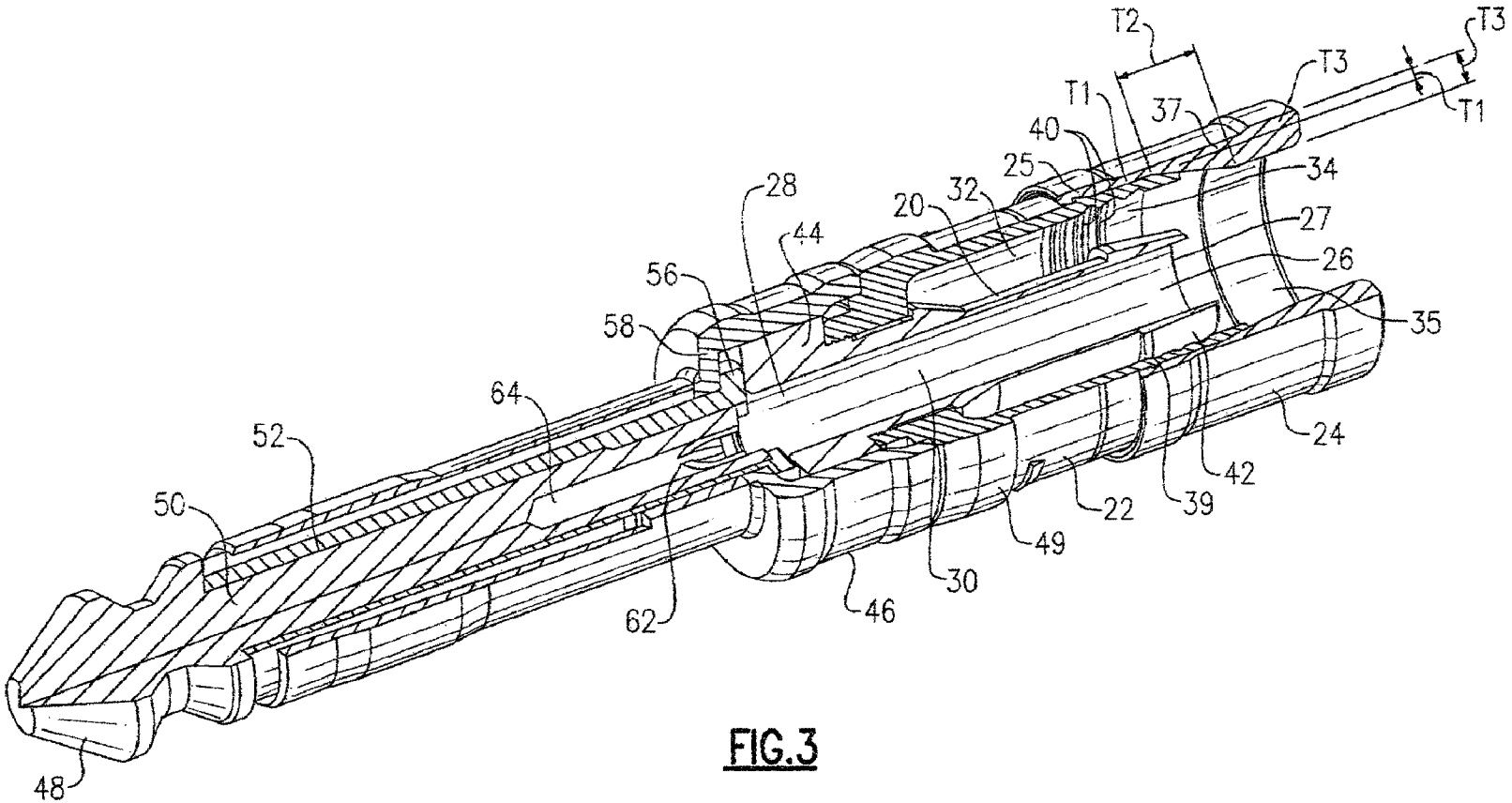
FIG. 3 is a sectional view of the phone plug connector device of FIG. 1.

The pin 47 may be configured with thin walls or slotted sections that make an electrical connection with the central conductor of a cable. The configuration of the pin is not limited to any such configuration and may include any configuration that allows electrical contact with the central conductor such as having a bore with a socket located therein for making electrical contact with the center conductor. FIG. 3 shows but one example of such a configuration with a socket 62 positioned in bore 64 of stem 50 for making contact between pin 47 and the central conductor of a cable.

In FIGS. 1-4, fastener 24 is preferably of tubular configuration having a first end 23 and a second end 31, which define a cavity 33 that is smaller in diameter at first end 23, increasing in diameter as the thickness of fastener 24 decreases and maintaining a substantially constant diameter at second end 31. A tapered surface 37 of the inner surface 35 of fastener 24 is provided and the diameter of the thickness of inner surface 35 increases with the taper. Tapered surface 37 allows movement of fastener 24 from a preassembled position to a fastened relationship (installed position) with the cable. Fastener 24 fits annularly onto connector body 22 by interference and is further engaged by a groove 25 disposed on the inner surface of the second end 31 of fastener 24 into which a detent 39 located on the outer surface of connector body 22 fits. The detent 39 of connector body 22 and the internal groove 25 of fastener 24 cooperate to insure that the fastener 24 is securely fastened to the connector body 22 in its first position or configuration. Although fastener 24 can be coupled to connector body 22 such that fastener 24 can be removed by hand, fastener 24 shown in the Figures is configured relative to the dimensions of connector body 22 so that fastener 24 is securely attached to connector body 22. In addition to the detent 39, groove 25 fastening attachment can also be enhanced by a snap fit or press fit device, or a combination of both.

Figure 4:
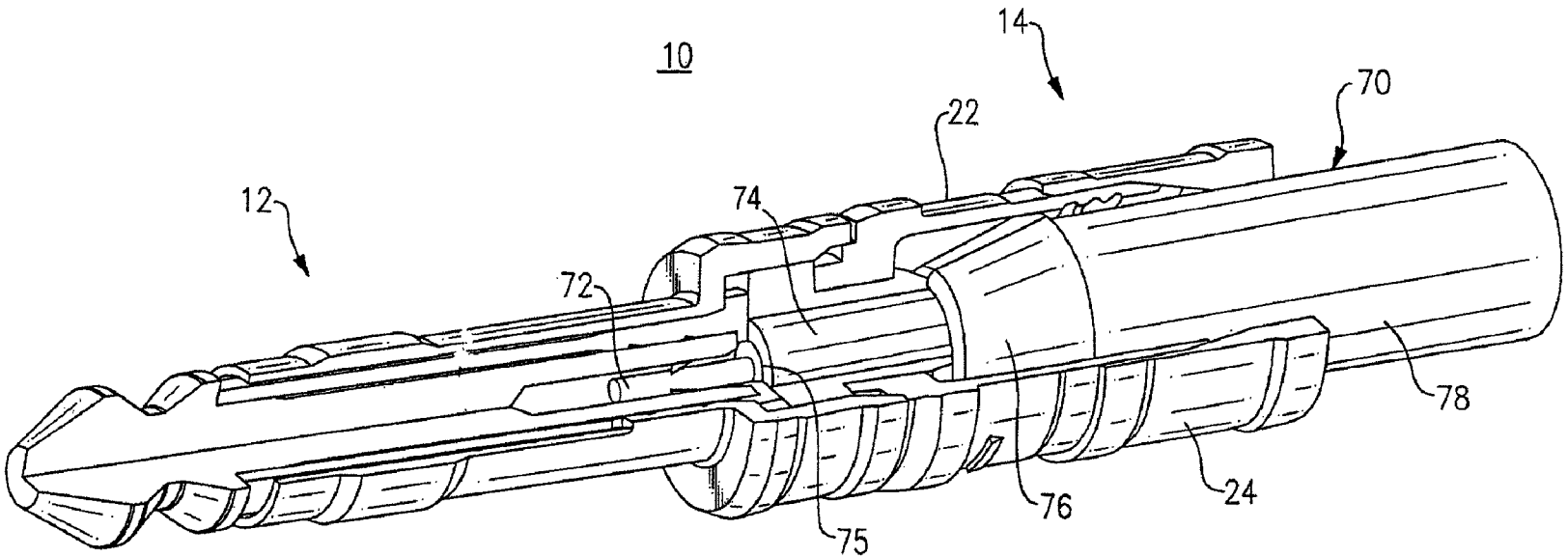
FIG. 4 is a perspective view of the phone plug connector device of FIG. 1 with a cable placed therein.

Fastener 24 is movably coupled to connector body 22 so as to be capable of being moved on the connector body 22 from a first preassembled configuration as shown in FIG. 4 to a second installed or assembled configuration with a cable mechanically and electrically connected therein. After a cable has been prepared and inserted within phone plug connector device 10, fastener 24 may be pushed forward over conductor body 22 as far forward as flange 49 on connector body 22. Cavity 33 of fastener 24 has a varied diameter, as defined by the thickness of fastener 24 having an initial constant thickness T1 that facilitates sliding of fastener 24 along the outer surface of connector body 22. The thickness begins to increase gradually for a length T2 to a point at which the thickness T3 becomes constant again, the thickness T3 being larger at end 23 in comparison to the thickness T1 at end 31, providing a solid interference fit between fastener 24 and connector body 22 proximate end 23 of fastener 24. Fastener 24 may be fabricated of a metal, plastic or similar material, and it is preferably formed of brass with a nickel or an electroless nickel/Teflon® finish.

In a pre-installed first configuration as illustrated in FIG. 1, fastener 24 is fastened onto connector body 22 such that second end 31 of fastener 24 is securely attached to connector body 24. Connector body 22 is securely fit within ribbed section 45 of post 20. Post 20 is fit within cap end 46 of shield 54 and against flange 56 of insulator 52 to mechanically and securely fit with phone plug 14. In this manner, fastener 24, in its pre-installed first configuration, is securely fastened to the connector body 24 and post 20 and is thus in an assembled state during storage, handling, and installation on a cable end. Similarly, phone plug 12 is preassembled and securely attached to connector 14 due to the interference fit of insulator 52. This eliminates any danger of any of the components being dropped or otherwise mishandled during handling and installation as is prevalent in known designs, which have many separate components that must be fit together at installation, such as that set forth is U.S. Pat. No. 6,786,774.

A method of positioning the connector device on a coaxial cable is now described with reference to FIG. 4. Phone plug 12 is already preassembled and already positioned in connector 14. The device 10 is provided as a unitary component that does not need to be disassembled for installation. The end of a coaxial cable is prepared by exposing a central core portion including the center conductor 72, insulator core 74 and foil 75. An outer braid conductor 76 is folded over the end of the outer sheath jacket 78. The prepared end of the coaxial cable 70 can be inserted through the first end 9 of fastener 24 such that the central core portion, including the center conductor 72, insulator core 74, and foil 75 are inserted into the first inner cavity 30 of post 20. A socket 62 positioned in bore 64 of pin 47 provides a first electrical contact to the cable 70 between the central conductor 72 of the coaxial cable and pin 47. The insulator core portion 74 and foil 75 of the cable are prevented from being displaced through second opening 28 of post 20. Also, the outer portion of the cable including the outer braid conductor 76 folded over the end of the outer sheath jacket 78 are received into the first outer cavity 32 through opening 34, providing the second electrical contact between post 20 and the outer braid conductor 76. Accordingly, electrical connection or conduction by compression is made between pin 47 and cable 70 by center wire 72 and socket 62 and by outer braid conductor 76 and post 20. Once the insulator core portion of the cable is positioned to abut stem 50 of pin 47, fastener 24 is then advanced or moved axially from its pre-installed first configuration to its second configuration by a standard compression tool.

Since the diameter of cavity 33 at first end 23 of fastener 24 is slightly smaller than the outer diameter of connector body 22 at first end 36, connector body 22 is concentrically gripped by fastener 24. Connector body 22 may be displaced or moved radially inwardly depending on how much fastener 24 is moved forward onto connector body 22. As a result, the outer portions, outer braid conductor 76 and outer sheath jacket 78 of the cable are firmly gripped or clamped between the outer surface of post 20 and connector body 22 by axial compression created by interference fit between all the components. In this manner, post 20 with raised lip 42 fits within the annular serrations 40 of connector body 22 to provide a generally continuous, 360° seal and grip on the outer portion of the cable. Advantageously, this eliminates the need for an 0-ring or other seal between connector body 22 and fastener 24, and can accommodate a wide range of cable types and sizes. Thus the need for connectors of various sizes can be avoided with a universal connector of the present invention. Although an 0-ring, which may be conductive, or similar seal is not needed, one may be used if it desired.

It should be also mentioned that post 20 provides not only good electrical connection for outer braid 76, but also provides a protective electrical shield for central conductor 72, preventing interference from external electrical conductors. The protective electrical shield continues with the shield 54, extending the length of the pin stem 50. Accordingly, the protective shield extends the length of the phone plug connector device 10 due to shield 54 and post 20. Moreover, post 20 provides the added benefit of adding support and integrity to the connector device 10 providing strength to the cable connection, whereby the tensile or mechanical strength of the connector device 10 may be greater than the breaking strength of the cable itself. Depending on the tensile or mechanical strength of the connector relative to the cable, if the connector device 10 and cable 70 are subjected to stress, strain or other pressure, the cable 70 will break or tear before the connector device 10 fractures or before the cable is released from the grip of the connector device. The connector devices described herein do not create stress concentrations, but distribute the stress more evenly around the circumference of the cable.

Figure 5:
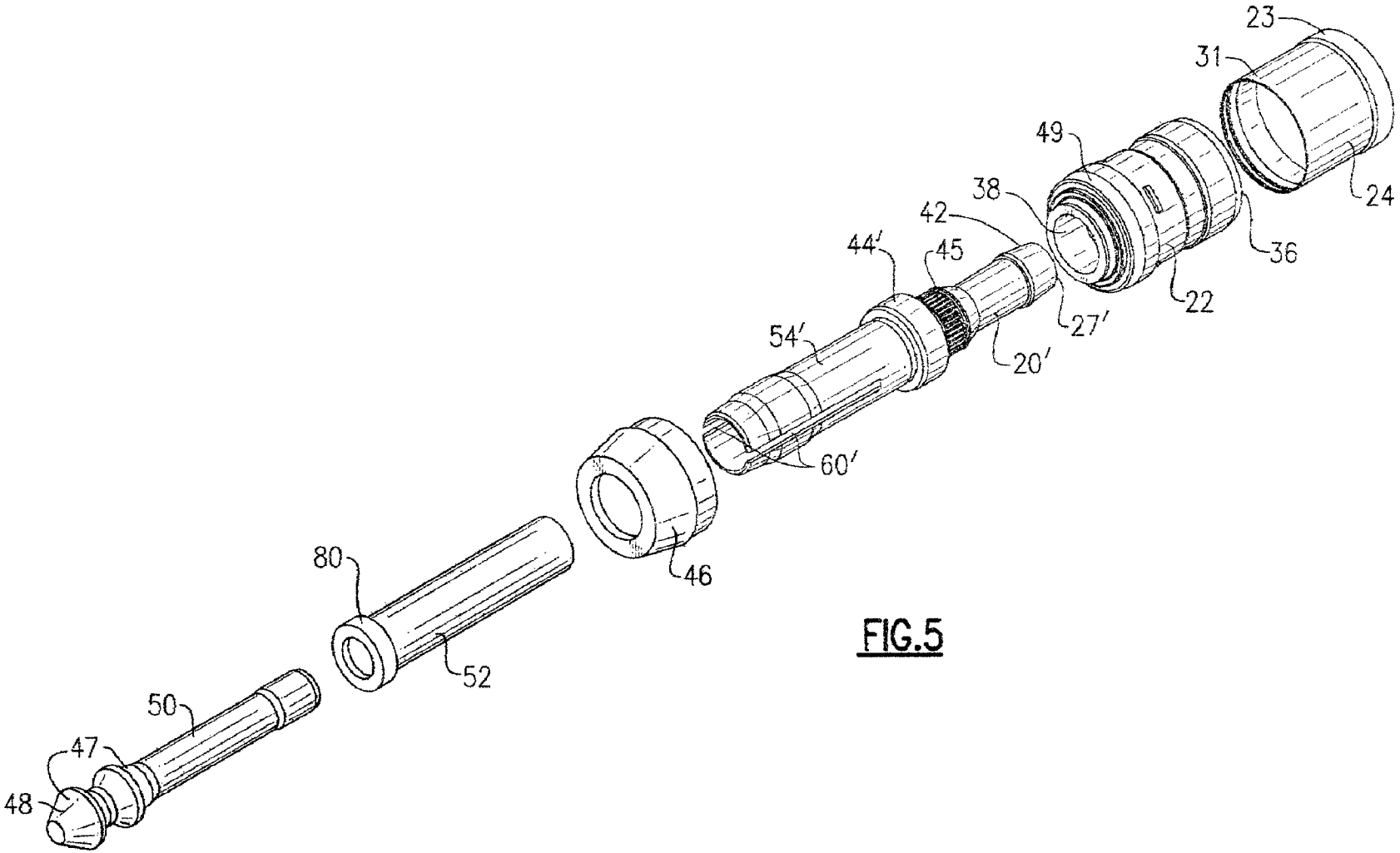
FIG. 5 is an exploded perspective view of another embodiment of a phone plug connector device of the present invention.
Figure 6:
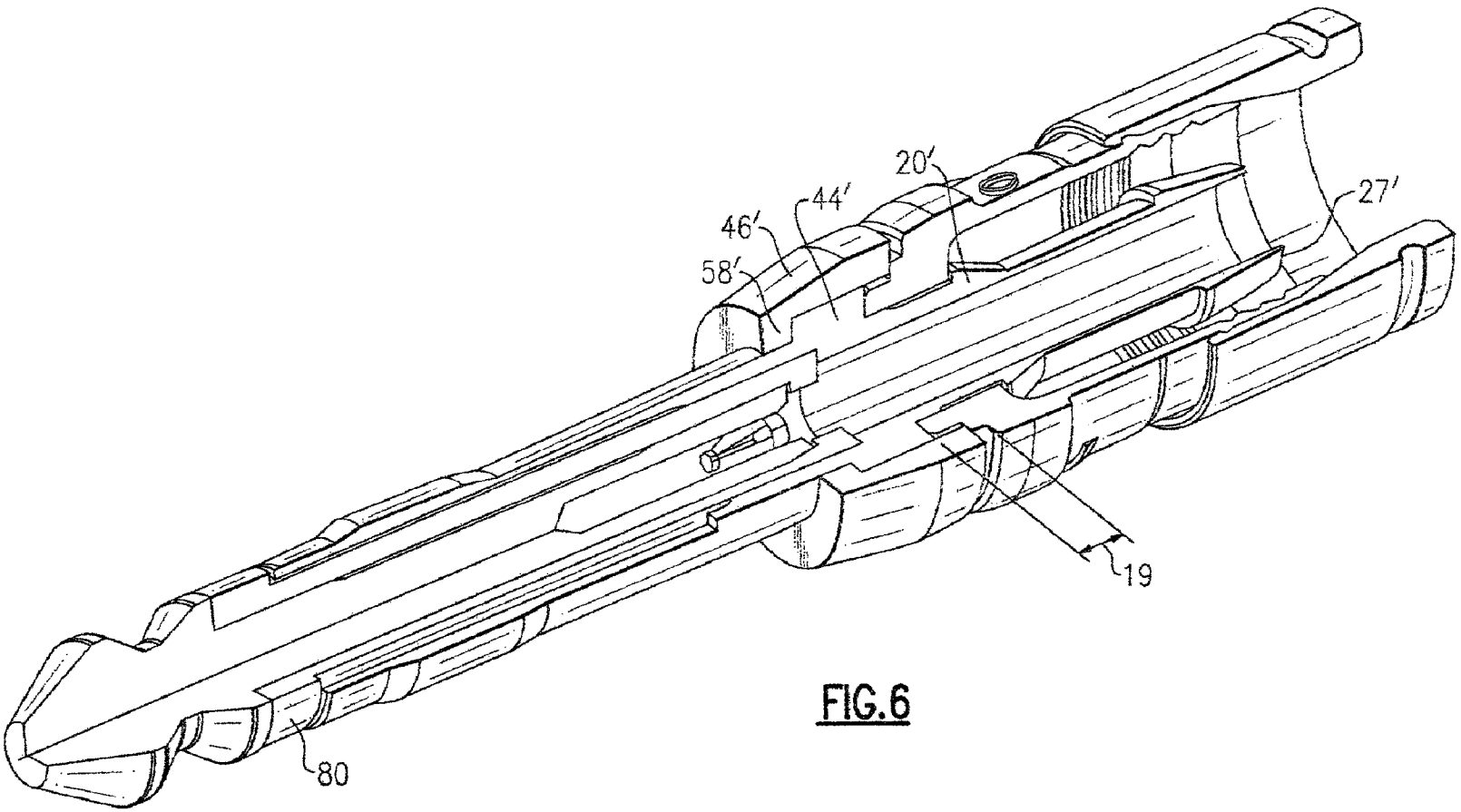
FIG. 6 is a sectional view of the phone plug connector device of FIG. 5.

In another embodiment of the present invention, FIGS. 5 and 6 show an alternate post 20' having post section 21', a first end 27' having a first flange 42', a second flange 44' and a ribbed section 45' proximate the second flange 44'. Post 20' further includes a shield section 54' which extends over stem 50 of pin 47. Post 20' combines a post section 21' and a shield section 54' into a single unit. The combination of post section 21' and shield section 54' in a single unit may be accomplished by machining from a single piece of metal stock or by joining two separate pieces together by welding, soldering, adhesive bonding or other industrial joining processes. Shield section 54' includes slits 60' extending longitudinally thereon to further assist in maintaining phone plug 12 in a jack when in use. A cap 46' includes a rim 58' that abuts the second flange 44' of post 20' at a first end, covers second flange 44' and abuts stepped section 19 of connector body 22. Cap 46' (shoulder 46) provides an opposing force to press against when fastener 24 is being moved forward (to the left) during installation of a cable. Accordingly, compression of fastener 24 over the connector body 22 is facilitated by cap 46' (and shoulder 46 of shield 54 in previous embodiment). Insulator 52' is slightly modified in comparison with insulator 52, having a lip 80, which fits with end of shield section 54' by interference fit. The remainder of the components are the same as those shown in FIGS. 1-4.

Figure 7:
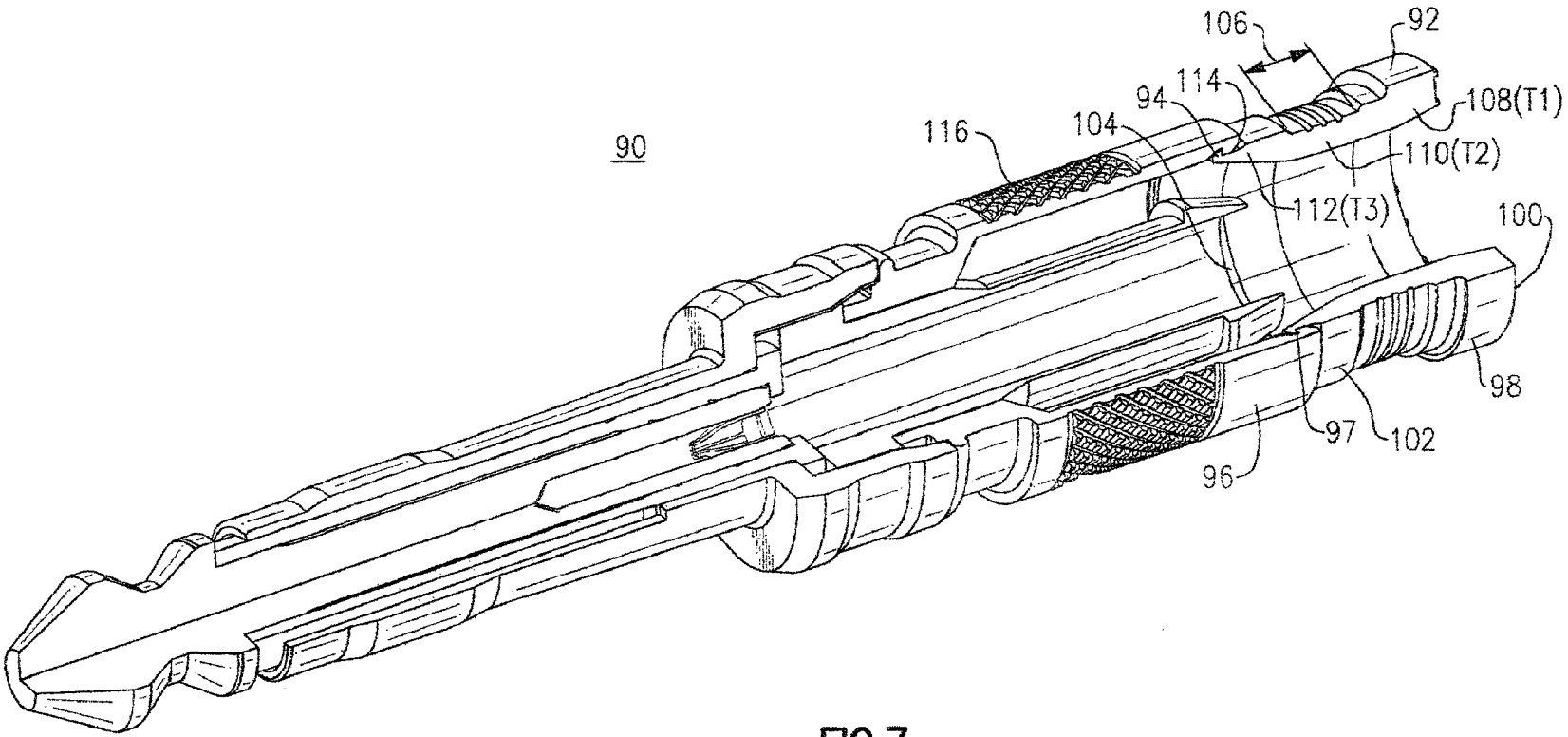
FIG. 7 is a perspective view of another embodiment of a phone plug connector device of the present invention.

FIG. 7 shows yet another embodiment of the present invention. A phone plug connector device 90 shown in FIG. 7 is similar to device 10 shown in FIGS. 2 through 4. In device 90 a fastener 92 includes a detent 94 which locks into groove 97 shown located on connector body 96. The mechanical fit maintains fastener 92 on connector body 96 when in preassembled, preinstalled configuration. The exterior surface of fastener 92 includes a first flange 98 on a first end 100 and a second flange 102 on second end 104. A ribbed section 106 on the exterior surface of fastener 92 assists with maintaining fastener 92 within connector body 96 when fastener 92 is moved radially within connector body 96 over a cable (similar to the cable shown in FIG. 4) to compress and maintain a cable in place. Moreover, the inner diameter of fastener 92 varies over the length of fastener 92. First end 100 includes a first taper 108 with very slight increase in thickness from end 100 inwardly (T1). Fastener 92 exhibits a constant thickness 110 midway through fastener 92 (T2) to a point at which the thickness includes a second taper 112, whereby the thickness decreases from the constant thickness to end 104 (T3). The second taper 112 eases the sliding of fastener 92 over a cable inserted into the connector when moved from this first position to a second position over the cable and constant thickness 110 fits against and maintains the cable in place when fastener 92 is in second position. Fastener 92 is moved forward and axially over a cable inside connector body 96 to a second position. In second position, first flange 98 abuts the first end 114 of connector body 96. Connector body 96 may include a textured surface 116 for easy gripping and handling. The remainder of the components are the same of those shown in device 10 in FIGS. 2-4.

Figure 8:
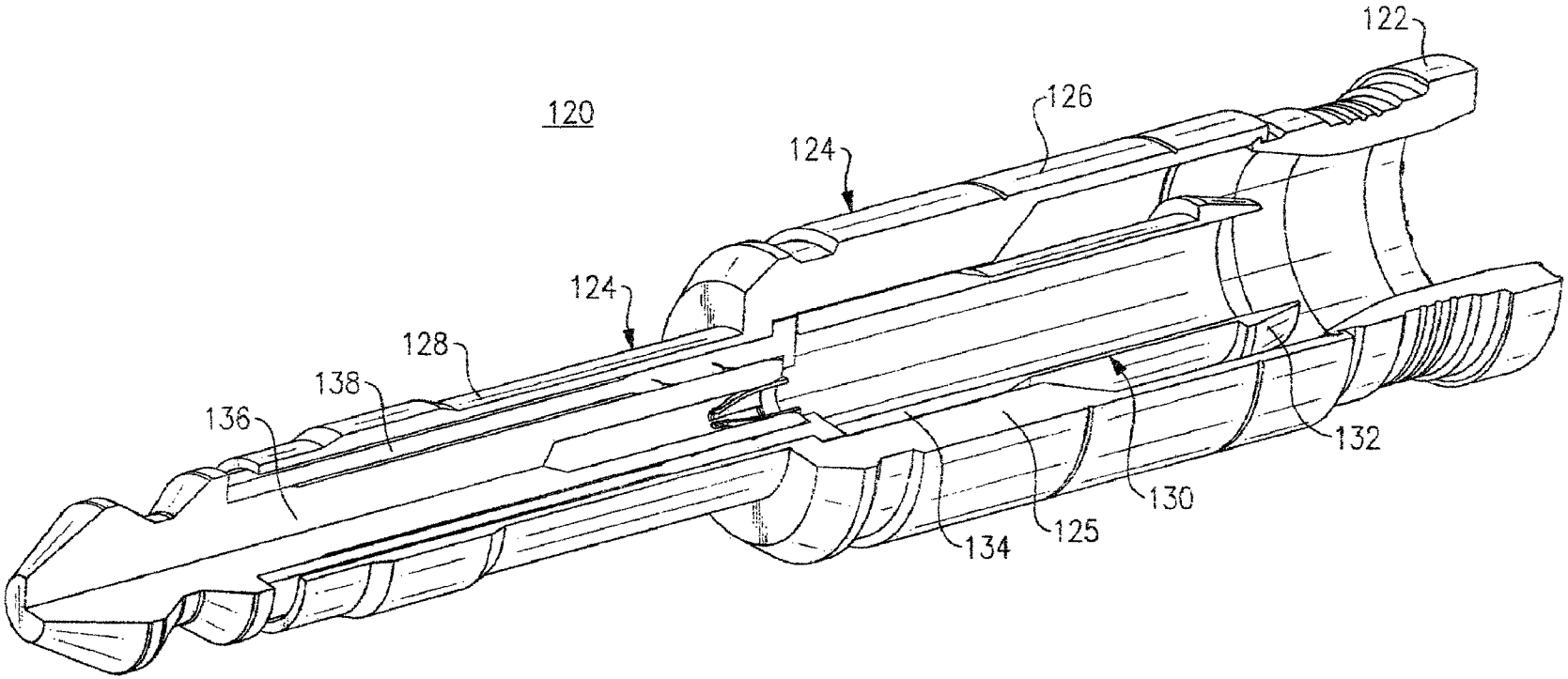
FIG. 8 is a perspective view of a further embodiment of a phone plug connector device of the present invention.

FIG. 8 shows an additional embodiment of the present invention. A phone plug connector device 120 shown in FIG. 8 is similar to device 90 shown in FIG. 7. In device 120, a fastener 122 is similar to fastener 92 in the embodiment shown in FIG. 7. Device 120 includes a connector body 124, which includes a body section 126 and a shield section 128 in a single unit. The combination of body section 126 and shield section 128 in a single unit may be accomplished by machining from a single piece of metal stock or by joining two separate pieces together by welding, soldering, adhesive bonding or other industrial joining processes. Body section 126 of connector body 124 includes an internal lip or flange section 125 in the interior of the connector body 126. Post 130 includes a first flange 132 and a second flange 134, which second flange 134 press fits or fits by interference within body section 124 at lip 125. Shield section 128 of connector body 124 is disposed radially on stem 136 and insulator 138. The remainder of the components are similar to embodiments shown in FIGS. 2 and 7.

Figure 9:
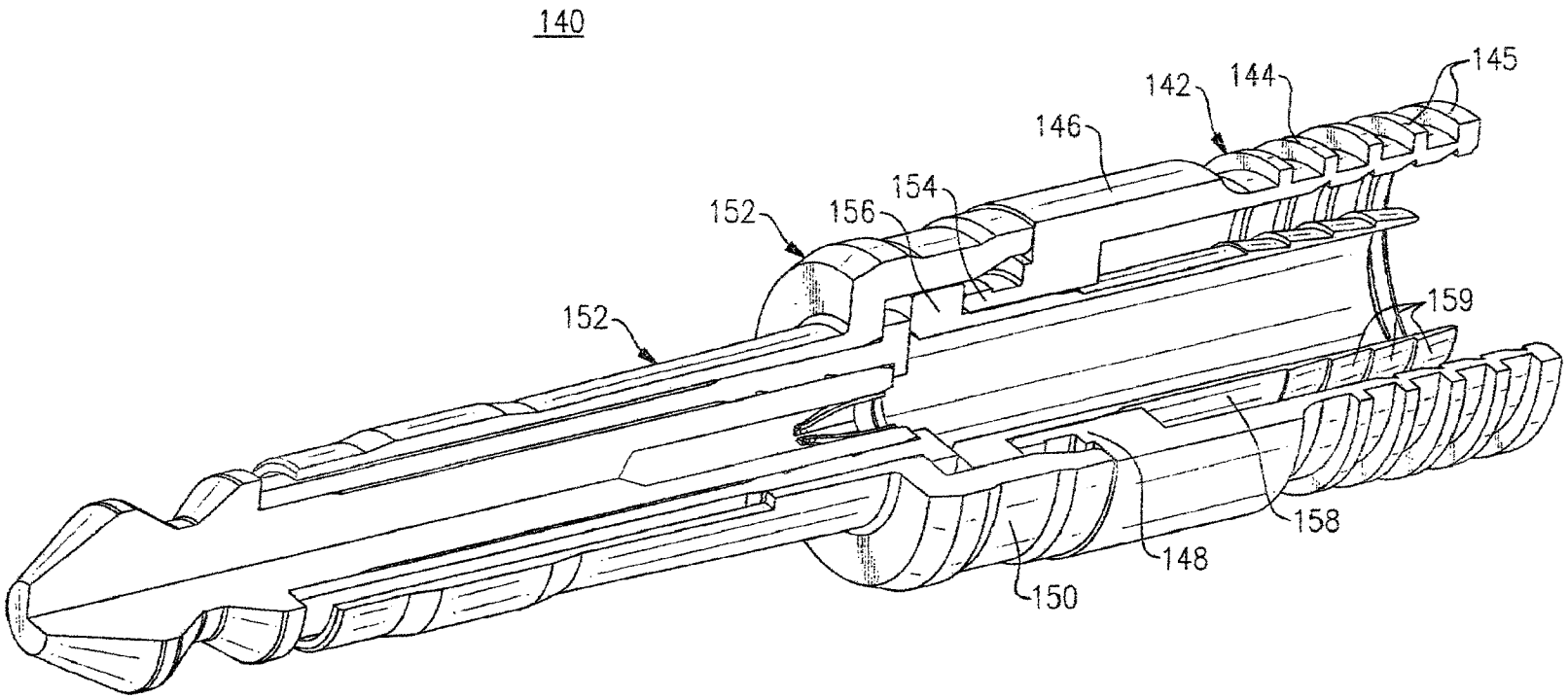
FIG. 9 is a perspective view of another embodiment of a phone plug connector device of the present invention.

FIG. 9 shows a further embodiment of the present invention. A phone plug connector device 140 shown in FIG. 9 is similar to device 90 shown in FIG. 7. In device 140, a fastener 142 includes a fastener section 144 with a series of ridges 145 and a connector body section 146 in a single unit. A flange 148 on connector body section 146 of fastener 142 abuts the edge of shoulder 150 of shield 152, and lip 154 on connector body section 146 of fastener 142 abuts a flange 156 on post 158. Post 158 includes a series of serrations 159 to enhance the fastening of the cable section inserted between post 158 and fastener 142. Fastener 142 is shown in preassembled or first position. After a cable is inserted as described above in previous embodiments, fastener section 144 is crimped radially at ridges 145 to fasten to the cable.

Figure 10:
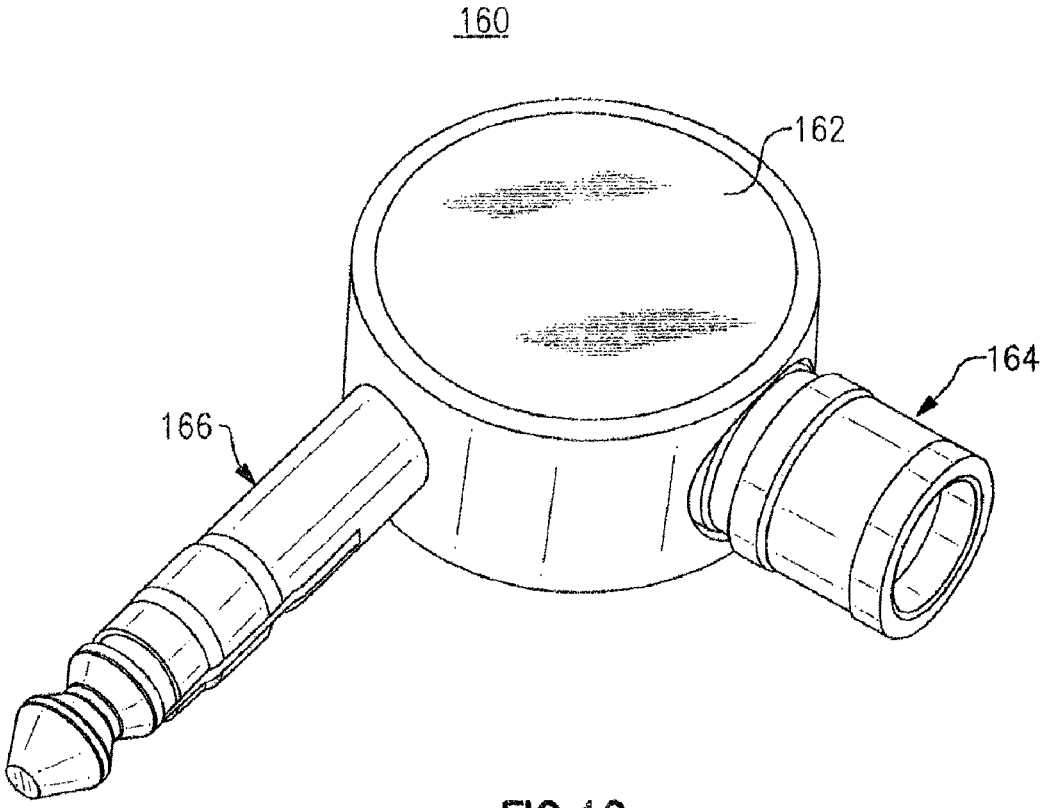
FIG. 10 is a perspective view of yet another embodiment of a phone plug connector device of the present invention.
Figure 11:
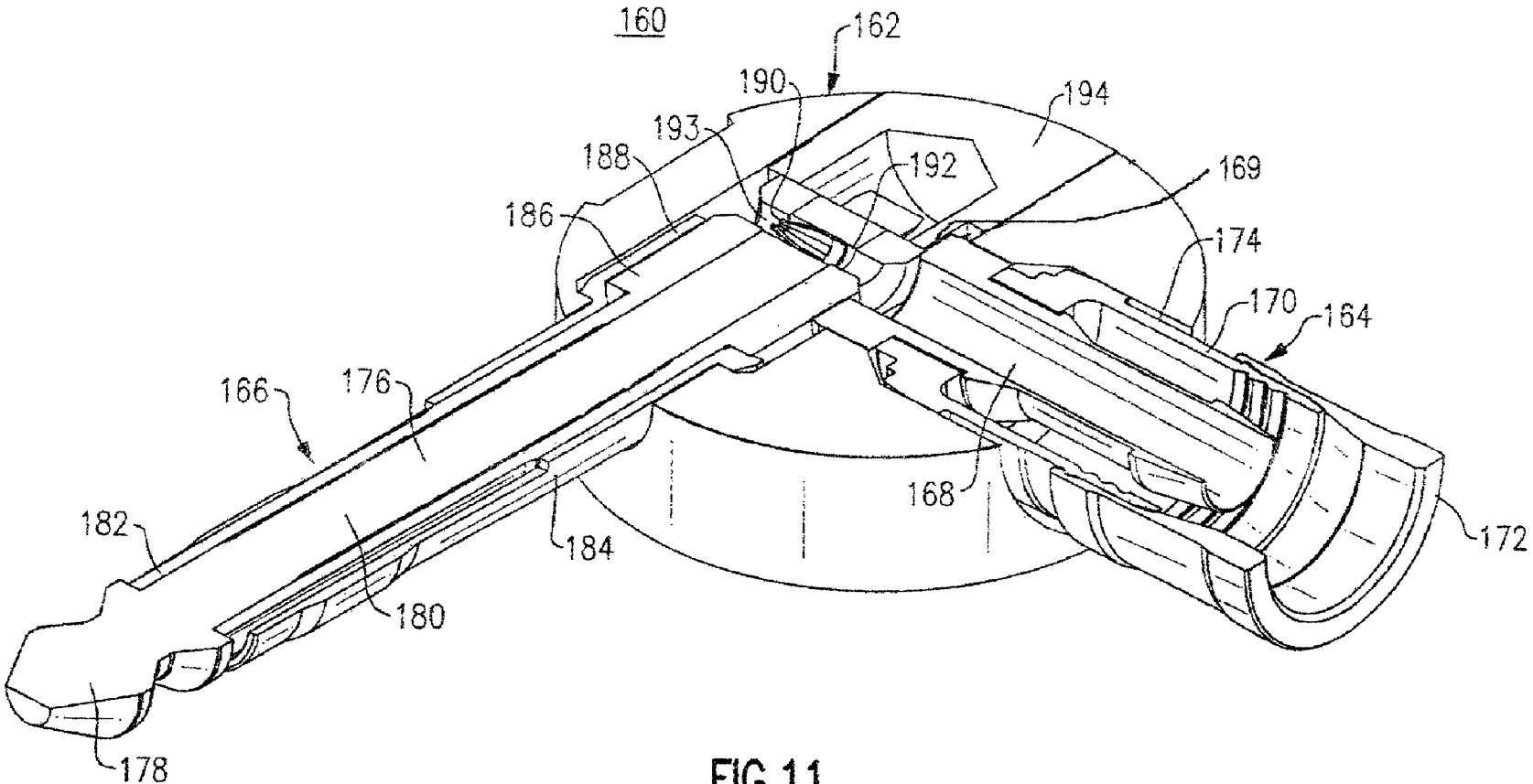
FIG. 11 is a sectional view of the phone plug connector device of FIG. 10.
Figure 12:
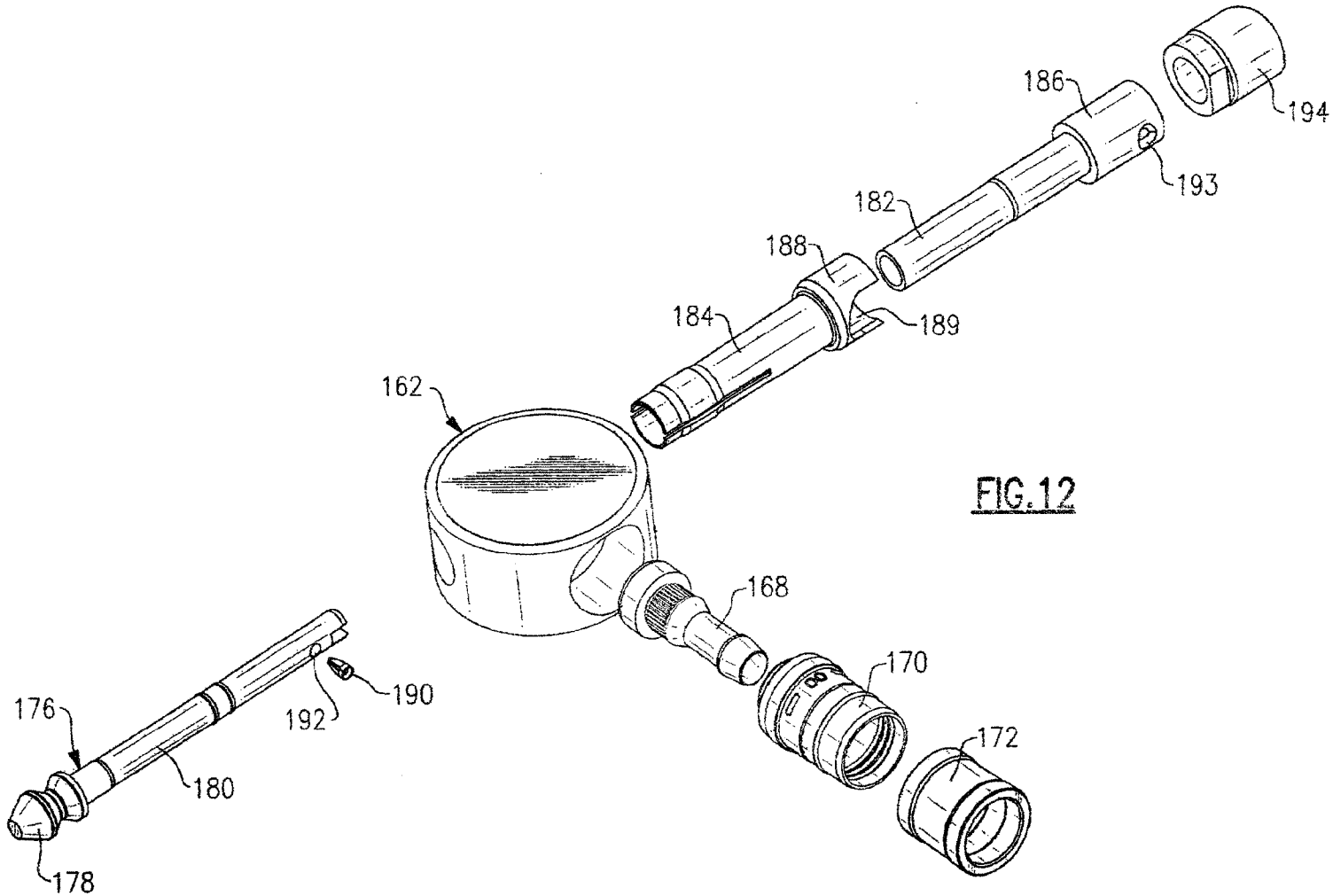
FIG. 12 is an exploded perspective view of the phone plug connector device of FIG. 10.

FIGS. 10-12 shows yet another embodiment of the present invention. All embodiments discussed previously have shown alignment of the phone plug and the connector in parallel axial alignment. In certain circumstances, it may be advantageous to have an angled configuration of the phone plug and the connector to provide space for additional plugs or to provide a certain direction for the cable to follow.

In FIGS. 10-12, a phone plug connector device 160 having an angled configuration is shown. An intermediate joining component 162 contains and securely retains connector 164 and phone plug 166. In FIG. 10, connector 164 is shown positioned at 90 degrees to phone plug 166. The angle of position of phone plug 166 and connector 164 is not limited to 90 degrees, and any angle of position is possible. The components of connector 164 and the components of phone plug 166 are the same as or similar to those components shown and discussed in the previous embodiments. The connector 164 includes a post 168, connector body 170, and fastener 172, all of which fit together by interference or press fit as described above. Furthermore, post 168 and connector body 170 fit within intermediate joining component 162 by interference or press fit. The connector 164 is shown in preassembled or first position. After a cable is inserted into connector 164, fastener 168 is moved radially forward on connector body 170 and within opening 174 to fasten a cable within connector body 170.

Phone plug 166 includes a pin 176 having a tip 178 and a stem 180. An insulator 182 is radially disposed on stem 180 and a shield 184 is radially disposed on insulator 182. Shield 184 includes a flange 186 that fits within a collar 188 of shield 184, the components fitting together and within intermediate joining component 162 by interference or press fit. Collar 188 includes a cut-out or opening 189 on one side to facilitate assembly and accommodate the protruding end 169 of post 168. A socket 190 is positioned laterally in a bore 192 in stem 180 for electrical contact with a cable to be inserted in connector 164. Flange 186 includes a bore 193, which will be aligned with bore 192 in stem 180 for access by the center conductor to bore 192 and socket 190. Flange 186 also prevents contact between post 168 and stem 180. The center conductor of a cable will be positioned in socket 190 similar to that shown in FIG. 4, whereas the insulator and foil portions will about the surface of flange 186. The outer braid of the conductor will be disposed between the post 168 and connector body 170 as discussed in previous embodiments. A cap 194 is inserted in an opening of the intermediate joining component 162 to seal the opening from external prodding. Cap 194 includes a notch 95 for allowance or access of post 168 to move forward into intermediate joining component.

The intermediate joining component 162 provides a secure housing for the connector 164 and phone plug 166 and additionally for a cable that will be fastened therein. It is preferable that the intermediate joining component is preassembled at a factory with all components in place to allow for easy installation of a cable without the need for loose or separate components. As with all the above-described and further described embodiment herein, the phone plug connector device is provided as a single unitary device without loose or separate components.

Figure 13:
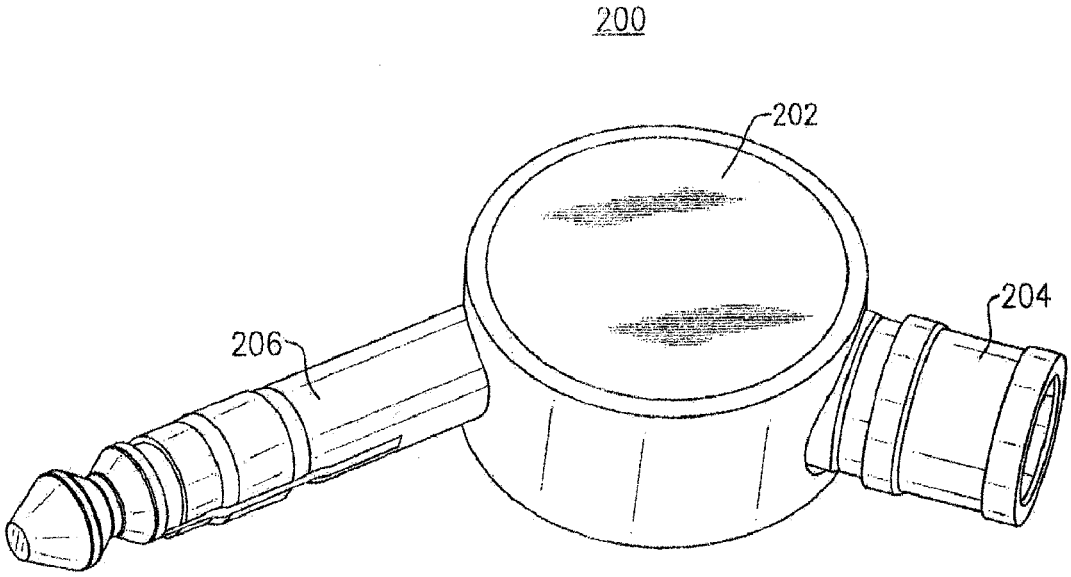
FIG. 13 is a perspective view of still another embodiment of a phone plug connector device of the present invention.
Figure 14:
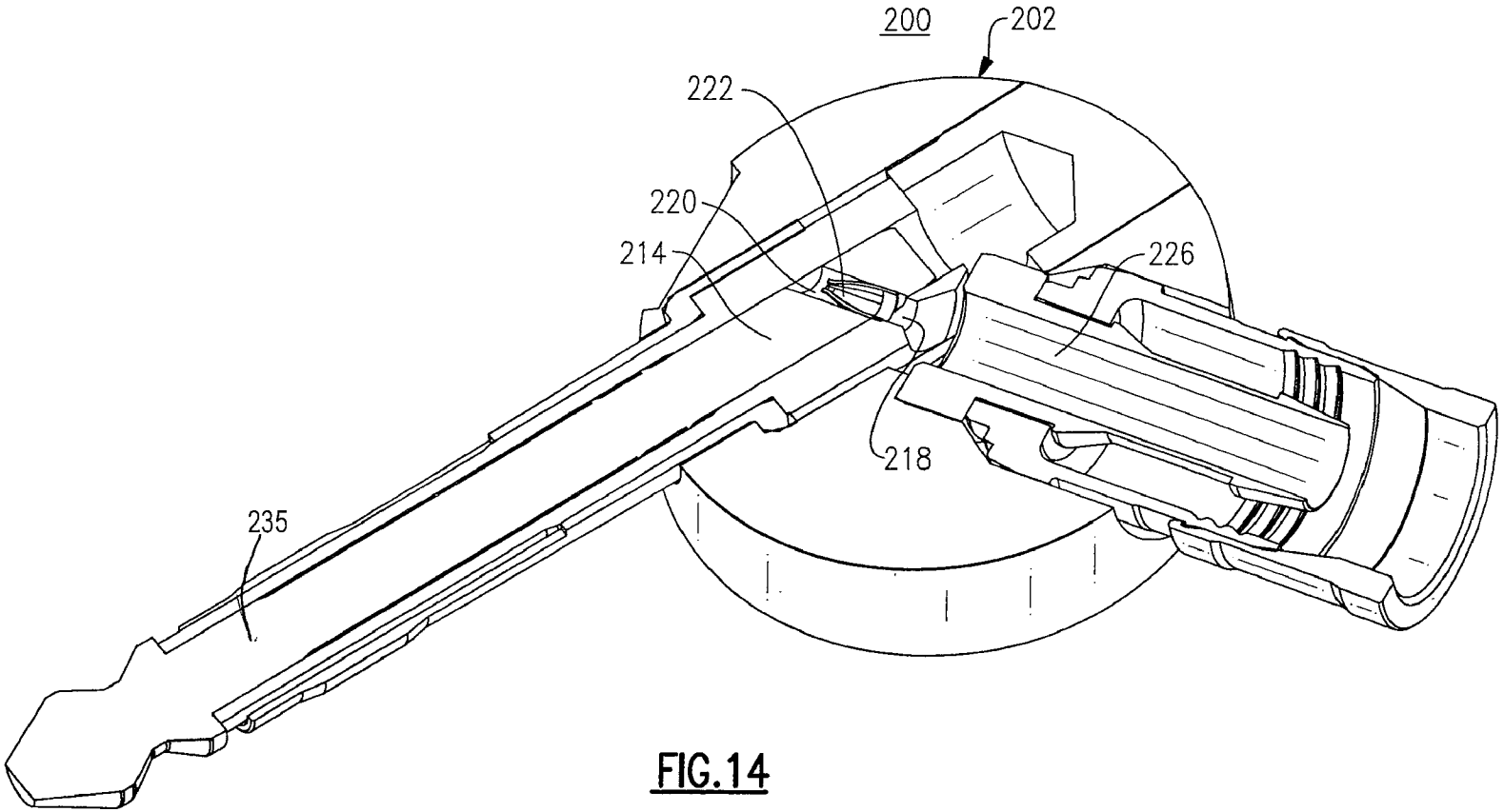
FIG. 14 is a sectional view of the phone plug connector device of FIG. 13.
Figure 15:
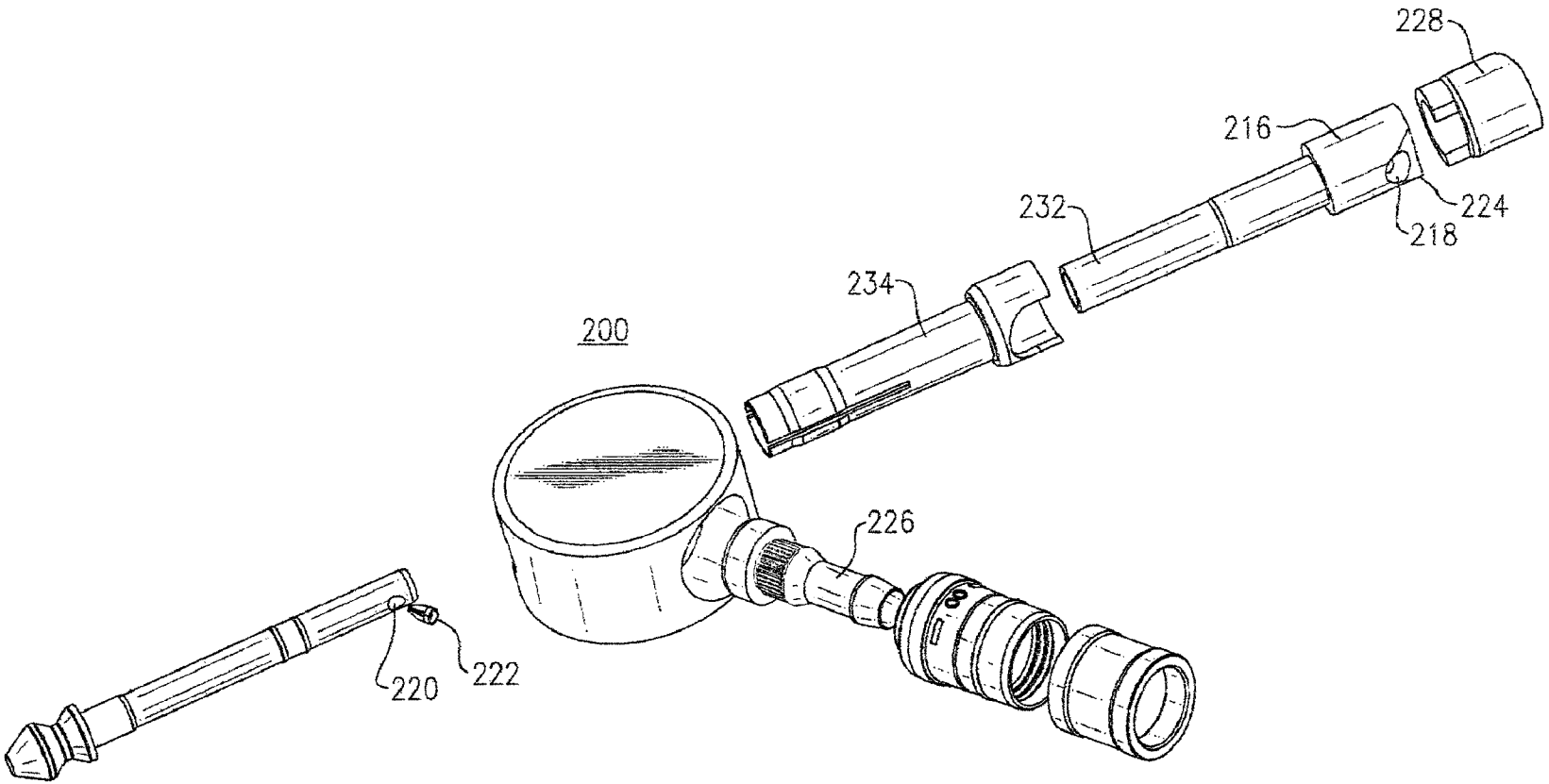
FIG. 15 is an exploded perspective view of the phone plug connector device of FIG. 13.

FIGS. 13-15 provide a further embodiment of the present invention. An angled configuration of a phone plug connector device 200 is shown. An intermediate joining component 202 contains and securely retains connector 204 and phone plug 206. The angle at which connector 204 and phone plug 206 are positioned is approximately 135 degrees, although this is by no means limiting and any angular orientation may be realized herein. A flange 216 located on insulator 232 includes a bore 218 for alignment with bore 220 in stem 214 for access by the center conductor into bore 218 and socket 222. Flange 216 further includes a notched surface 224 for access and axial alignment of post 226 with bore 218. Similarly, cap 228 includes an opening 230 for access and axial alignment of post 226 with bore 218. Insulator 232 prevents contact between post 226 and stem 235.

The components of connector 204 and the components of phone plug 208 are the same as those components shown and discussed in the previous embodiment shown in FIGS. 10-12, the difference being the angle of position of the components and also the position of a socket 222 in bore 220 of stem 214, along with the slight variations in the insulators and the caps, as discussed above, to allow for movement and alignment of the post with the bore in the stem of the pin. It should be mentioned that the assembly of the angled embodiments is such that the insulator, shield, and cap are pushed through a first opening on one side of the intermediate joining component, and the pin of the phone plug is pushed through the first opening on the opposite side of the intermediate joining component. The pin, insulator, shield, and cap press fit or fit by interference in the intermediate joining component and are maintained in the opening once it is inserted. The connector is inserted in a second opening, which axis is positioned at an angle with respect to the axis of the first opening of the intermediate joining component. The connector fits within the intermediate joining component by press fit or by interference and is maintained in the opening in which it was inserted. The need for additional tools or loose components is avoided with the plug connector device of the present invention. The embodiments showing the angled versions of the phone plug device may include any configuration that is used in the axial alignment constructions described herein.

The strength of the connection between the cable and the connector devices described herein is very good, and may be greater than the breaking strength of the cable itself. Accordingly, the connector devices are able to withstand high stresses and strains during use, e.g., those great enough to break the cable. The strength of the cable will typically fail before the connector device fails or breaks.

It is important to mention that the embodiments of the present invention provide a device having a series of conductors concentrically arranged in the device. The post and the shield of the device can maintain the continuity of the electromagnetic shield provided by the outer conductor of the coaxial cable. The shield extends 360° the full length of the connector, from the post to the outer conductor of the coaxial cable. Additionally, the preassembled unitary construction of the devices prevent loss or mishandling of components during installation.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A phone plug connector device for use with a coaxial cable, the coaxial cable including a center conductor, a first dielectric layer surrounding the center conductor, and a first conductive sheath coaxial with the center conductor and surrounding the first dielectric layer, the device comprising:

a phone plug and a connector;

wherein the connector comprises a first conductor and a second conductor that is electrically separate from the first conductor;

wherein the phone plug comprises a first pin comprising a first electrical contact and a second electrical contact that is electrically separate from the first electrical contact;

wherein the first pin is located, sized, and shaped to be removably inserted into a phone jack connector;

wherein the first conductor of the connector is electrically connected to the first contact of the phone plug;

wherein the second conductor of the connector is electrically connected to the second contact of the phone plug.

2. The phone plug connector device of claim 1 provided in a preassembled single unit configuration prior to installation of the cable.

3. The phone plug connector device of claim 1 wherein the strength of the connection between the connector device and the cable is greater than the breaking strength of the cable when the cable is fastened therein.

4. The phone plug connector device of claim 1 wherein the phone plug comprises a conductive tip and a stem and wherein the series of conductors comprises a portion in the stem of the phone plug configured for engaging and electrically contacting the center conductor of the coaxial cable and a post located in the connector for electrically contacting the at least first, conductive sheath.

5. The phone plug of claim 4 wherein the connector further comprises a connector body; and a fastener;

wherein the fastener is remains engagement with the connector body in both a connected position and an unconnected position;

wherein the connector body is configured for an interference fit with the post; and wherein upon axial advancement of the fastener, the connector securely fastens to the cable by compression.

6. The phone plug connector device of claim 5 wherein the post is tubular for receiving the coaxial cable, the tubular post having a first end and a second end, a first flange disposed on the outer surface of the first end and a second flange of greater diameter disposed on the outer surface of the second end;

the connector body disposed radially about the tubular post, wherein the connector body is radially spaced about the post to define a first outer cavity between the post and the connector body, the connector body having a first end and a second end, wherein the second end of the connector body abuts the second flange of the post; and the fastener disposed radially about a portion of the connector body, the fastener having an internal wall thickness of varying thickness over three sections, wherein the first section has a constant thickness T1, the second section has a tapered thickness T2, and the third section has a constant thickness T3, wherein T1 is greater than T3 and wherein T2 decreases in thickness from T1 to T3, and wherein the fastener engages the connector body at the tapered thickness of the second section when the fastener is in a first position.

7. The phone plug connector device of claim 6 wherein the fastener engages the connector body by interference fit at the first section having thickness T1 when the fastener is in a second position, wherein the fastener radially compresses the connector for a compressed fit with the cable in the second position.

8. The phone plug connector device of claim 4 further comprising:

a first insulator disposed on the stem;

a shield disposed on the first insulator, wherein the shield comprises a shoulder for interference fit with the post and connector body.

9. The phone plug connector device of claim 8 wherein the shield further comprises a plurality of slots therein.

10. The phone plug connector device of claim 6 wherein the second flange of greater diameter disposed on the outer surface of the post is disposed at a midpoint on the post, the post further comprising a shield section, wherein the shield section extends radially over the length of the stem of the pin, an insulator disposed between the stem and the shield section, whereby the shield section, insulator and stem are configured for interference fit with each other.

11. The phone plug connector device of claim 5 wherein the post is tubular for receiving the coaxial cable, the tubular post having a first end and a second end, a first flange disposed on the outer surface of the first end and a second flange of greater diameter disposed on the outer surface of the second end;

the connector body configured for interference fit with the post, the connector body disposed radially about the tubular post, wherein the connector body is radially spaced about the post to define a first outer cavity between the post and the connector body, the connector body having a first end and a second end, wherein the second end of the connector body abuts the second flange of the post;

the fastener disposed radially inside an edge of the connector body, the fastener having an internal wall thickness of varying thickness over three sections, wherein the first section has a tapered thickness T1, the second section has a constant thickness T2, and the third section has a tapered thickness T3, wherein thickness T3 is less than thickness T1; and wherein the connector body engages the fastener by interference fit when a cable is disposed in the connector and the fastener is in a second position, the fastener radially compresses the cable for a compressed fit with the cable.

12. The phone plug connector device of claim 4 wherein the connector further comprises a fastener, wherein the post and fastener are configured for an interference fit with the phone plug;

wherein the post is tubular for receiving the coaxial cable, the tubular post having a first end and a second end, a series of serrations disposed on the outer surface of the first end and a second flange of greater diameter disposed on the outer surface of the second end, the post comprising a first inner cavity;

the fastener configured for interference fit with the post, the fastener disposed radially about the tubular post, wherein the fastener is radially spaced about the post to define a first outer cavity between the post and the fastener, the fastener having a first end and a second end, wherein the fastener comprises a series of ridges disposed on the first end and wherein the second end of the fastener abuts the second flange of the post; and wherein the fastener radially engages a cable disposed in the post by radially crimping the series of ridges disposed on the fastener.

13. The phone plug connector device of claim 1 wherein the phone plug comprises a tip sleeve (TS) plug.

14. A method of mounting a phone plug connector device to a prepared end of a coaxial cable, the coaxial cable having a center conductor surrounded by at least a first dielectric, the at least first dielectric being surrounded by at least a first conductive sheath, and the at least first conductive sheath surrounded by a protective outer jacket, the method comprising:

(a) providing a phone plug and a connector;

wherein the connector comprises a first conductor and a second conductor that is electrically separate from the first conductor;

wherein the phone plug comprises a first pin comprising a first electrical contact and a second electrical contact that is electrically separate from the first electrical contact;

wherein the first pin is located, sized, and shaped to be removably inserted into a phone jack connector;

wherein the first conductor of the connector is electrically connected to the first contact of the phone plug;

wherein the second conductor of the connector is electrically connected to the second contact of the phone plug (b) fastening the connector onto the prepared end of a coaxial cable in a single axial movement, wherein the connector is irreversibly fastened to the coaxial cable.

* * * * *